US006357080B1

(12) United States Patent
Tsai

(10) Patent No.: US 6,357,080 B1
(45) Date of Patent: Mar. 19, 2002

(54) MULTI-SECTIONS RETRACTABLE HANDLE

(76) Inventor: James Tsai, No. 103, Ta-Ming 1 Rd., Tung Pao Village, Tan Tzu Hsian, Taichung Hsien (TW)

( * ) Notice: Subject to any disclaimer, the term of this patent is extended or adjusted under 35 U.S.C. 154(b) by 0 days.

(21) Appl. No.: 09/691,854

(22) Filed: Oct. 18, 2000

(51) Int. Cl.[7] ..... A45C 3/00; B25G 1/04; B62B 7/00

(52) U.S. Cl. ..... 16/113.1; 280/47.315; 280/655

(58) Field of Search ..... 16/113.1, 405, 16/429; 190/115, 39, 18 A; 280/655, 655.1, 47.31, 47.315

(56) References Cited

U.S. PATENT DOCUMENTS 5,488,756 A * 2/1996 Hsieh ..... 16/113.1
5,692,266 A 12/1997 Tsai
5,806,143 A 9/1998 Tsai
5,911,263 A * 6/1999 Wu ..... 16/113.1
6,128,806 A * 10/2000 Shou-Mao ..... 16/113.1
6,141,828 A * 11/2000 Kuo ..... 16/113.1
6,148,477 A * 11/2000 Cheng ..... 16/113.1

* cited by examiner

*Primary Examiner*—Chuck Y. Mah
(74) *Attorney, Agent, or Firm*—Browdy and Neimark P.L.L.C.

(57) ABSTRACT

A retractable handle includes a handgrip, pairs of first tubes, second tubes and third tubes slidably coupled to one another, two first locating devices and two second locating devices adapted to lock the first tubes or the second tubes in the extended position or received position, wherein the second locating devices each include a casing, having a top hole, and a passageway which have a first end hole and a second end hole at two distal ends thereof, a slide moved in and out of the top hole of the casing, the slide having a first sloping face and a second sloping face, a main elastic member against between the slide and the casing, a first retaining member and a second retaining member respectively positioned in the passageway, the first and second retaining members having a respective sloping face respectively against the first sloping face and second sloping face of the slide, which cause the first and second retaining member to move in and out of the first end hole and second end hole respectively when the slid is positioned at upper or lower and a second elastic member against between the first retaining member and the second retaining member.

9 Claims, 7 Drawing Sheets

MULTI-SECTIONS RETRACTABLE HANDLE

BACKGROUND OF THE INVENTION

The present invention relates to a retractable handle, and more particularly to a multi-sections retractable handle.

U.S. Pat. No. 5,806,143 discloses a 3-sections retractable handle for luggage. This structure of retractable handle comprises a handgrip, two first tubes (the structure and arrangement of the handgrip and the first tubes are seen in U.S. Pat. No. 5,692,266), two second tubes, and two locating sets. Each locating set comprises a first and a second retaining member. By means of the pressure from a respective sloping face, the first and second retaining members are moved between the extended locking position and the received unlocking position, to lock the second tubes in the extended or received position. Because the first retaining member and the second retaining member are disposed two sides of the respective locating set at different elevations, the retractable handle has a certain length when collapsed.

SUMMARY OF THE INVENTION

It is the main object of the present invention to provide positioning control device sets for retractable handle, which require less longitudinal installation space so that the retractable handle can be made having multiple sections slidably received one another.

To achieve these and other objects of the present invention, a multi-sections retractable handle comprises a handgrip, which comprises a main control set; two first tubes respectively connected to two distal ends of the handgrip and arranged in parallel; two second tubes respectively sleeved onto the first tubes for enabling the first tubes to be moved with the handgrip in and out of the second tubes between an extended position and a received position; two first locating devices adapted to lock the first tubes in the extended position or the received position; two third tubes respectively sleeved with the second tubes for enabling the second tubes to be moved in and out of the third tubes between an extended position and a received position, the third tubes each having a first retaining hole near a top end thereof and a second retaining hole near a bottom end thereof; and two second locating devices respectively mounted in the bottom end of the second tubes and adapted to lock the second tubes in the extended position or the received position. The second locating devices each comprise a casing, the casing comprising a top hole, and a transverse passageway, the passageway having a first end hole and a second end hole at two distal ends thereof; a slide provided in the casing and enable to move longitudinally, the slide comprising at least one first sloping face and at least one second sloping face positioned in the passageway; a main elastic member mounted inside the casing and against between the slide and the casing; a first retaining member and a second retaining member respectively positioned in the passageway of the casing and adapted to move in and out of the first and second end holes of the passageway of the casing respectively, the first retaining member having at least one sloping face against the first sloping face of the slide, the second retaining member having at least one sloping face against the second sloping face of the slide, a second elastic member is against between the first retaining member and the second retaining member. When the second tubes are moved to the extended position, the first retaining members of the second locating devices are respectively engaged into the first retaining holes of the third tubes to lock the second tubes in the extended position. When the first tubes are respectively received in the second tubes, the slides of the second locating devices are lowered with the first locating devices to force the first and second sloping faces thereof against the first and second retaining members of the second locating devices, thereby causing the first retaining members of the second locating devices to be disengaged from the first retaining holes of the third tubes and received inside the respective casings for enabling the second tubes to be respectively received in the third tubes, and the second retaining members of the second locating devices are respectively forced outwards and engaged into the second retaining holes of the third tubes to lock the second tubes in the received position.

DETAILED DESCRIPTION OF THE PREFERRED EMBODIMENT

Figure 1:
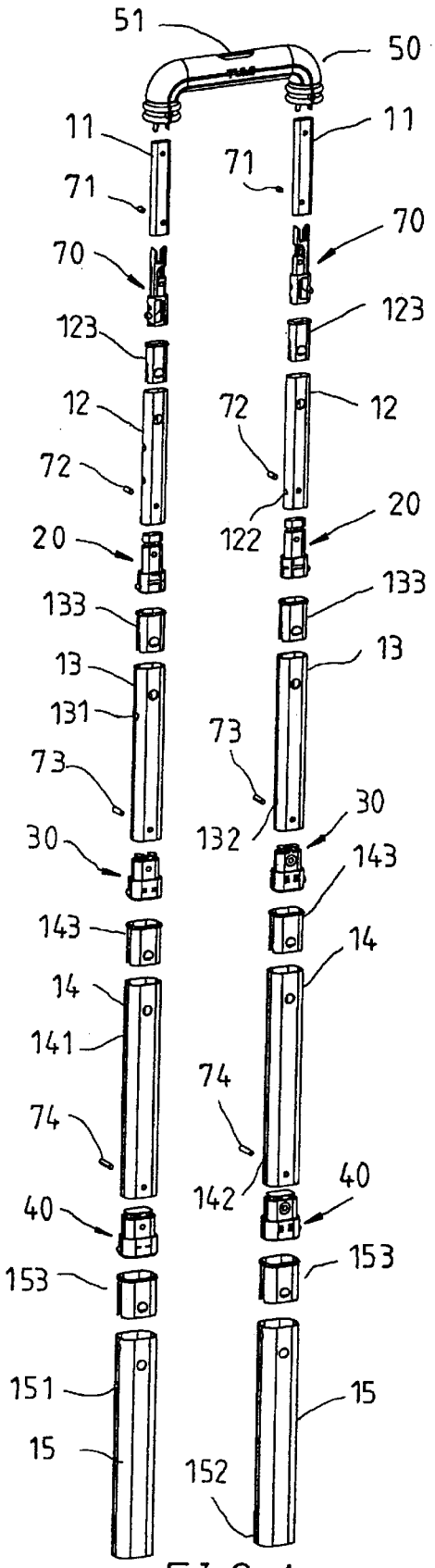
FIG. 1 is an exploded view of a retractable handle according to the present invention.

Referring to FIG. 1 a retractable handle in accordance with the present invention comprises a handgrip 50, pairs of tubes of different diameters adapted to slide one inside another, the pairs of tubes including two first tubes 11, two second tubes 12, two third tubes 13, two fourth tubes 14 and two fifth tubes 15, a main control device 60, and pairs of locating devices including two first locating devices 70, two second locating devices 20, two third locating devices 30 and two fourth locating devices 40.

Please refer to the U.S. Pat. No. 5,692,266 for the detail structures of the handgrip 50, the main control device 60 and the first locating devices 70.

The third, fourth and fifth tubes 13, 14 and 15 each have a top end, a bottom end, a first retaining hole 131, 141 or 151 disposed at the right side near the top end, a'second retaining hole 132, 142 or 152 disposed at the left side near the bottom end, and a connector 133, 143 or 153 mounted on the top end. The first tubes 11 are axially slidably mounted in the second tubes 12. The second tubes 12 are axially slidably mounted in the third tubes 13. The third tubes 13 are axially slidably mounted in the fourth tubes 14. The fourth tubes 14 are axially slidably mounted in the fifth tubes 15.

Figure 2:
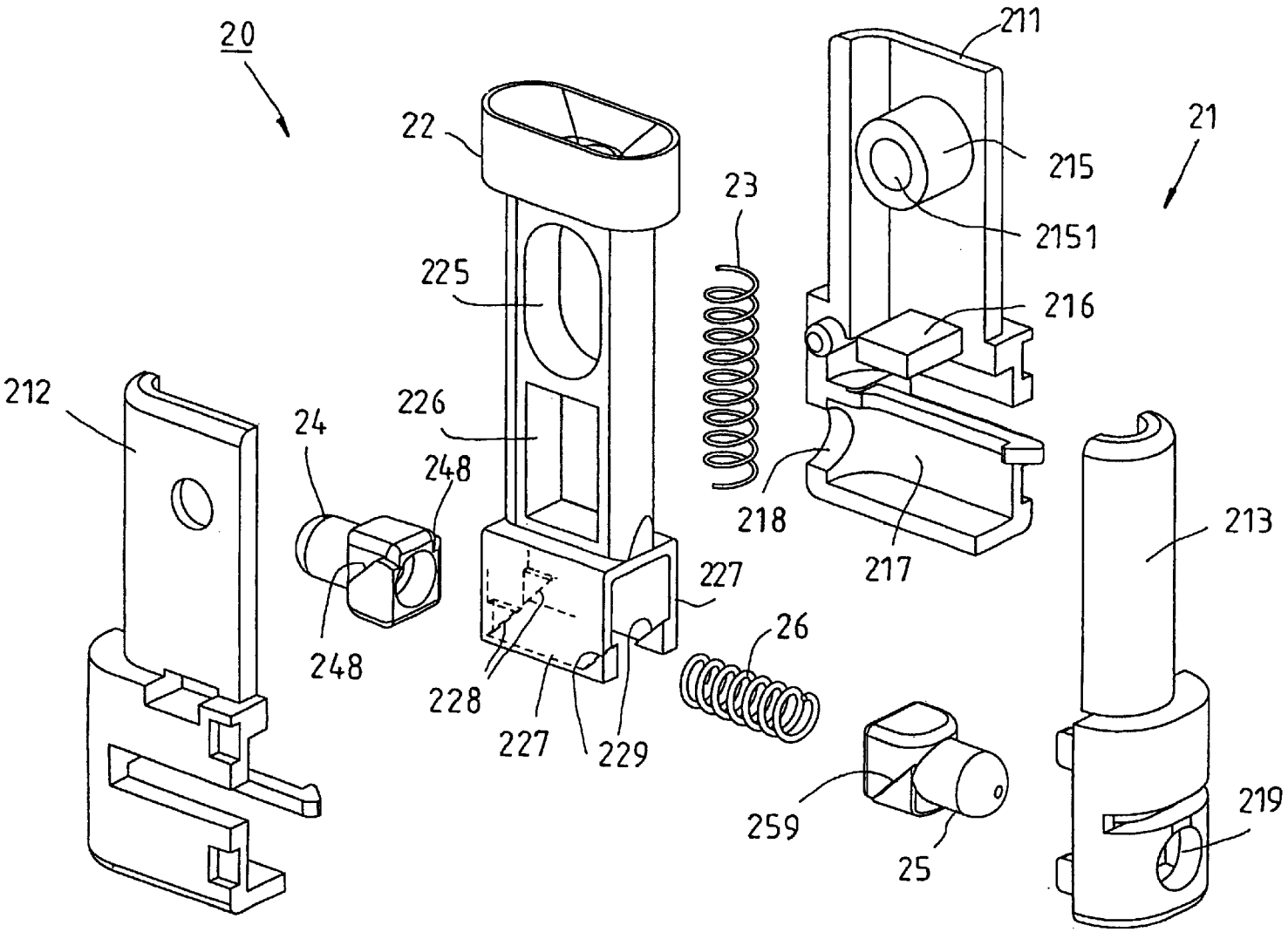
FIG. 2 is an exploded view of a first locating device for the retractable handle according to the present invention.
Figure 3:
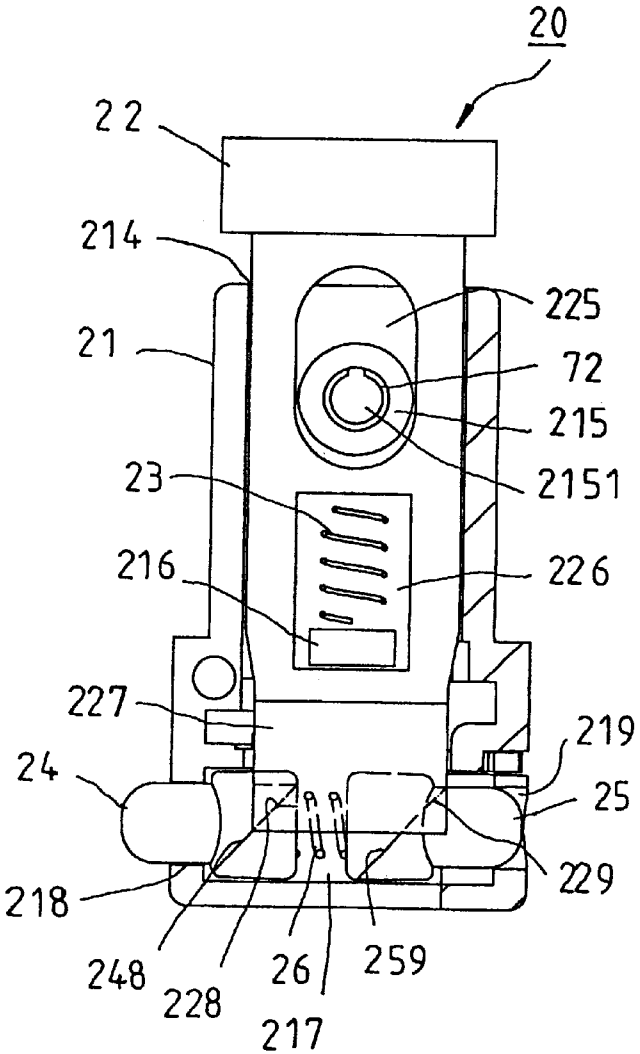
FIG. 3 illustrates the status of the second locating device in the extended locking position according to the present invention.

Referring to FIG. 2, each second locating device 20 is comprised of a casing 21, a slide 22, a main elastic member 23, a first retaining member 24, a second retaining member 25, and a horizontal spring 26. The casing 21 is formed of an outer shell 211, an inner shell 212, and a lateral shell 213. The shells 211, 212 and 213 are fastened together, defining top hole 214 at the top end of the casing. The inner shell 212 comprises a post 215 protruded from the inside wall thereof, and a through hole 2151 axially extended through the post 215. The casing 21 is inserted into one second tube 12 from the bottom side, and then a pin 72 is inserted into the through hole 2151 to secure the casing 21 to the corresponding second tube 12. The inner shell 212 further comprises a partition wall 216, which defines with the bottom wall of the casing 21 a transversely extended passageway 217, which has a first end hole 218 and a second end hole 219 at two distal ends. The slide 22 is mounted in the casing 21 and moved in and out of the top hole 211 of the casing 21, which comprises a first sliding slot 225 and a second sliding slot 226 disposed at different elevations. The post 215 and the partition wall 216 are respectively inserted through the first and the second sliding slot 226,225 to limit longitudinal sliding distance of the slide 22 relative to the casing 21. The slide 22 further comprises two drive plates 227 arranged in parallel at the bottom side thereof and suspended in the passageway 217. The drive plates 227 each comprises a first sloping face 228 sloping downwardly inwards at one side of the inner surface, namely, the left side, and a second sloping face 229 sloping downwardly outwards at the other side of the inner surface, namely, the right side. The main elastic member 23 is a compression spring which vertically against between the top end of the second sliding slot 226 of the slide 22 and the partition wall 216 of the casing 21, i.e., the slide 22 is supported on the main elastic member 23 and partially projecting out of the top hole 211 of the casing 21. The first and the second retaining member 24,25 are shaped like a cylinder having a sound end, which positioned in the passageway 217 in reversed directions and respectively aimed at the first end hole 218 and the second end hole 219. The first retaining member 24 has two sloping faces 248 respectively against the first sloping face 228 of the drive plates 227. The second retaining member 25 has two sloping faces 259 respectively against the second sloping face 229 of the drive plates 227. Please refer also to FIG. 3. When the first retaining member 24 extends out of the first end hole 218 and the second retaining member 25 is received inside the second end hole 219, the second locating device 20 is shifted to the extended locking position to lock the respective second tube 12 in the extended position. The second elastic member 26 is a compression spring positioned in the passageway 217 of the casing 21 and against between the first and the second retaining member 24 and 25.

Figure 4:
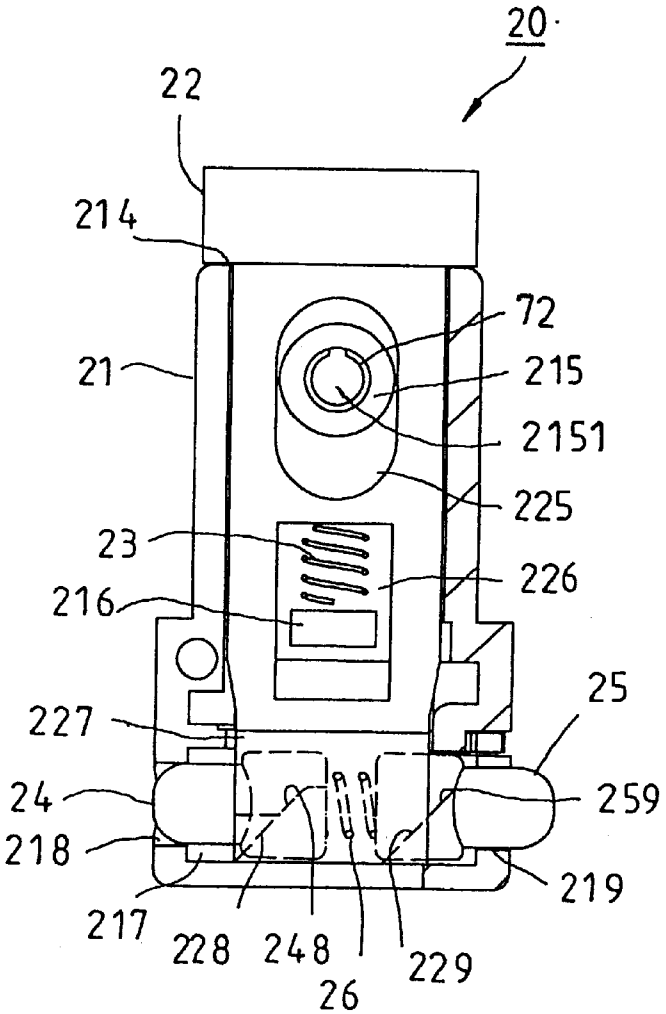
FIG. 4 illustrates the status of the second locating device in the received locking position according to the present invention.

Referring to FIG. 4, when the slide 22 of the second locating device 20 is forced downwards, the first sloping face 228 and the second sloping face 229 of each drive plate 227 are respectively pressed on the sloping faces 248 and 259 of the first retaining member 24 and the second retaining member 25, therefore the first retaining member 25 is pushed inwards to the inside of the first end hole 221, and the second retaining member 26 is pushed outwards and extended out of the second end hole 22, i.e., the second locating device 20 is shifted to the received locking position.

The aforesaid third locating devices 30 and fourth locating devices 40 are respectively installed in the third tubes 13 and fourth tubes 14 at the bottom side. The structure of the third locating devices 30 and fourth locating devices 40 are similar to the second locating devices 20, however the third locating devices 30 and fourth locating devices 40 have different diameters that fit the third tubes 13 and the fourth tubes 14 respectively.

Figure 5:
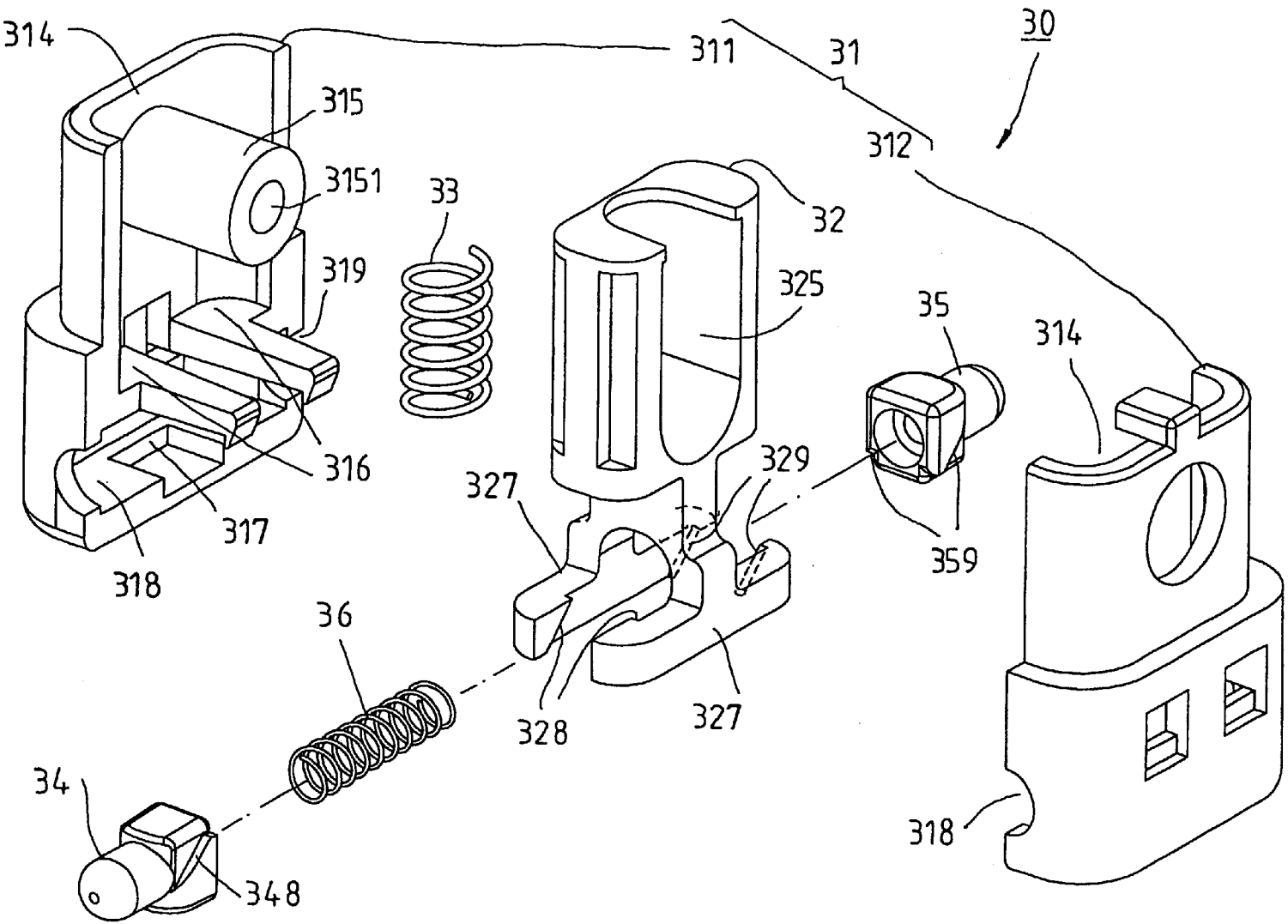
FIG. 5 is an exploded view of the third locating device for the retractable handle according to the present invention.
Figure 6:
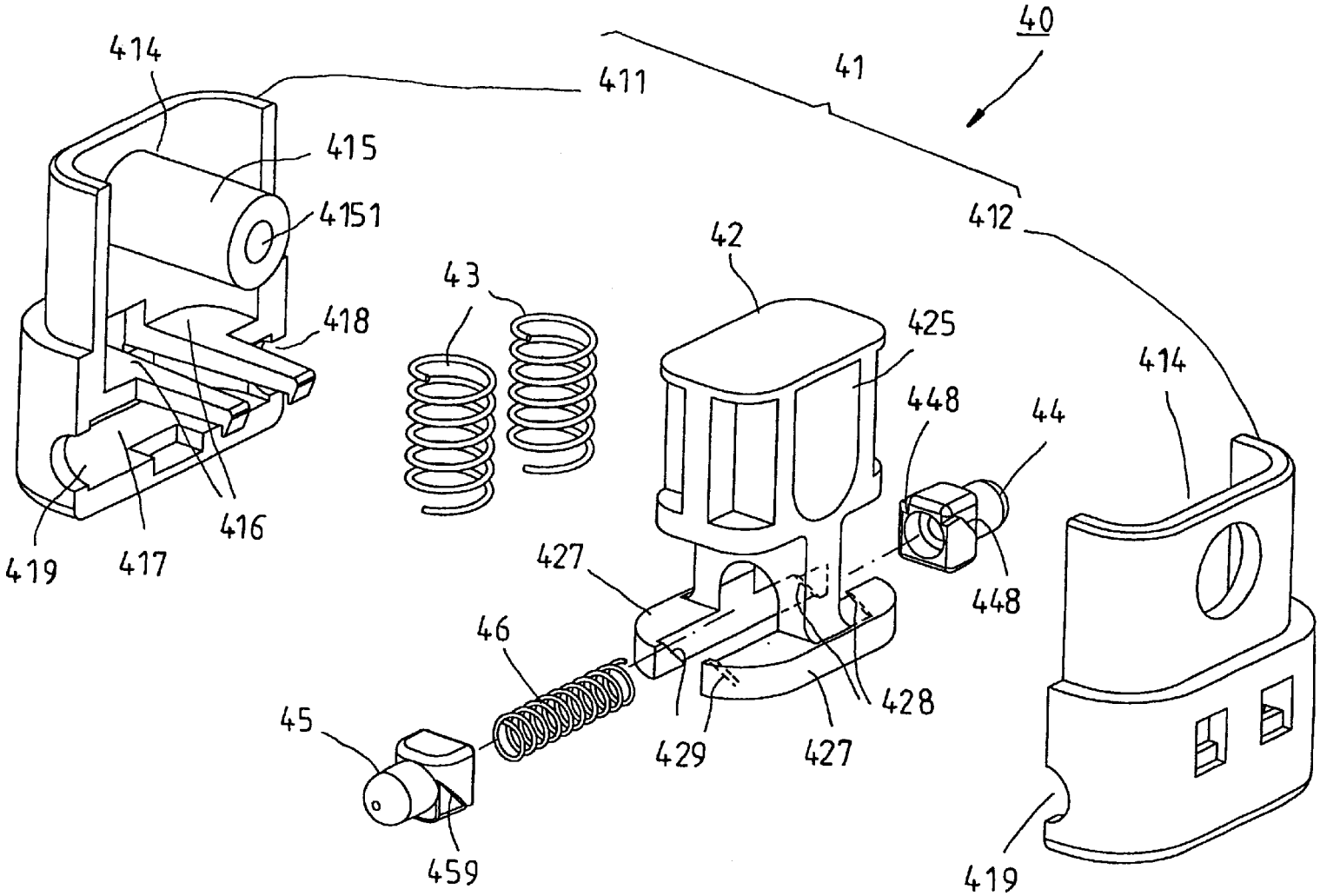
FIG. 6 is an exploded view of the fourth locating device for the retractable handle according to the present invention.

Referring to FIGS. 5 and 6, the third locating devices 30 and fourth locating devices 40 each comprise a casing 31 or 41 formed of an inner shell 311 or 411 and an outer shell 312 or 412, the casing 31 or 41 having a passageway 317 or 417 which have a first end hole 318 or 418 and a second end hole 319 or 419 at two distal ends, a slide 32 or 42, comprising two drive plates 327 or 427 positioned in the passageway 317 or 417 of the casing 31 or 41, the drive plates 327 or 427 each comprising a first sloping face 328 or 428 and a second sloping face 329 or 429 at two sides of the inner surfaces, a main elastic member 33 or 43 (the fourth locating devices 40 each has two main elastic members 43), a first retaining member 34 or 44 and a second retaining member 35 or 45 with two sloping faces 348 or 448 or 359 or 459, and a second elastic member 36 or 46. The function of the third and fourth locating devices 30 and 40 are same as the second locating devices 20.

Figure 7:
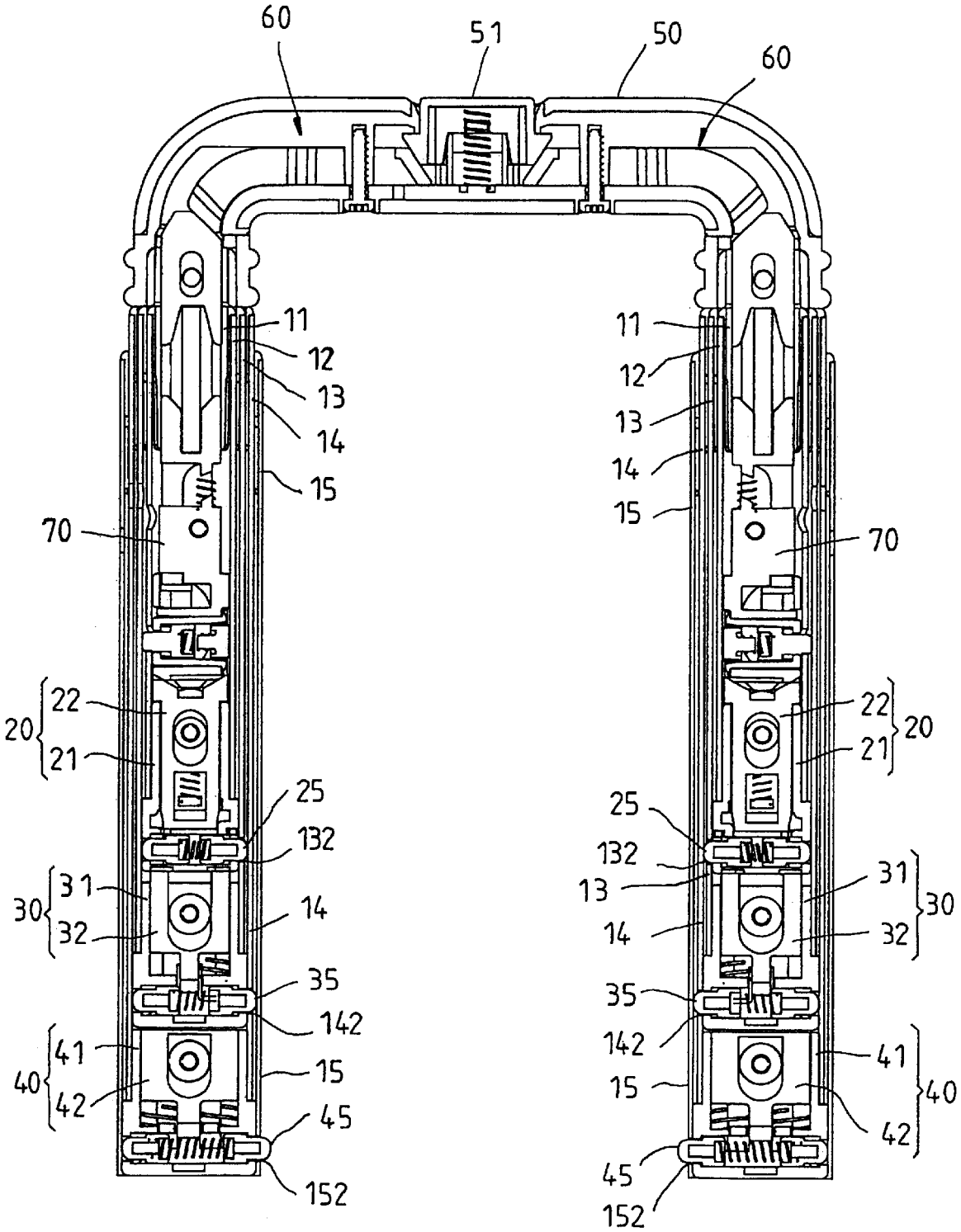
FIG. 7 is a sectional plain view showing the retractable handle locked in the received position according to the present invention.

Referring to FIG. 7, when moving the retractable handle downwards to the received (collapsed) position, the first locating devices 70 force the slide 22 of the second locating devices 20 downwards, and the second and third locating devices 20 and 30 respectively force the slides 32 and 42 of the third and the fourth locating devices 40 and 30 downwards, causing the second, third and fourth locating devices 20, 30 and 40 shifted to the received locking position, at this time, the second retaining members 25, 35 and 45 of the second, third and fourth locating devices 20, 30 and 40 are respectively engaged into the second retaining holes 132, 142 and 152 of the third, fourth and fifth tubes 13, 14 and 15, keeping the retractable handle in the received (collapsed) position.

Figure 8:
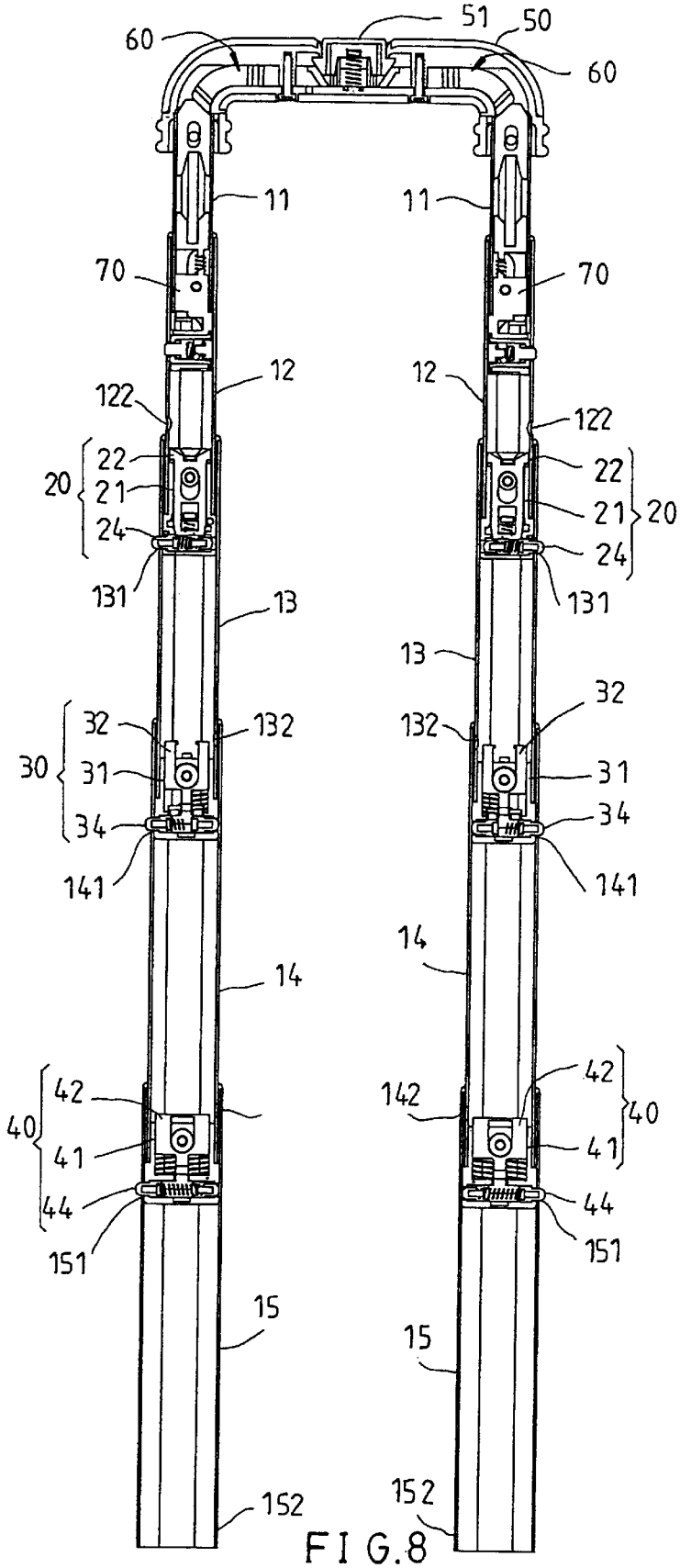
FIG. 8 is a sectional plain view showing the retractable handle locked in the extended position according to the present invention.

Referring to FIG. 8, when pressing down the press button 51 at the handgrip 50, the retaining members 71 of the first locating devices 70 are respectively forced inwards to release the first tubes 11 and the second tubes 12 (please refer to U.S. Pat. 5,692,266 for the detail action,). At this time, the slide 22 of each second locating device 20 is forced upwards by the respective main elastic member 23 to lift the first locating devices 70 and the first tubes 11, enabling the first tubes 11 to be pulled with the handgrip 50 out of the second tubes 12. At this time, the third locating devices 30 and the fourth locating devices 40 are respectively shifted to the extended locating position in good order, enabling the respective upper locating devices (and the respective tubes) to be forced upwards by the respective main elastic members. After the first retaining members 24, 34 and 44 of the second, third and fourth locating devices 20, 30 and 40 had been respectively engaged into the first retaining holes 131, 141 and 151 of the third, fourth and fifth tubes 13, 14 and 15, the retractable handle is locked in the extended position.

When returning the retractable handle from the extended position to the received position, the press button 51 at the handgrip 50 is pressed down to release the locking status of the first tubes 11 and the second tubes 12, enabling the first tubes 11 to be received in the second tubes 12 respectively. After the first tubes 11 had been lucking in the second tubes 12, the first locating devices 70 force down the slide 22 of each second locating device 20 to shift the second locating devices 20 to the received locking position, enabling the second tubes 12 to be received in the third tubes 13 respectively. The second locating devices 30 and the fourth locating devices 40 work in the same manner, enabling the third tubes 13 to be received in the fourth tubes 14 and the fourth tubes 14 in the fifth tubes 15. At final, the retractable handle is returned to the received (collapsed) position shown in FIG. 7.

According to the present invention, the length of the locating devices is relatively shorter than the prior art design, therefore the received length of the retractable handle is minimized. Further, according to the prior art design, a respective second elastic member is provided to support a respective retaining member. According to the present invention, one second elastic member is sufficient to support two retaining members.

While only one embodiment of the present invention has been shown and described, it will be understood that various modifications and changes could be made thereunto without departing the spirit and scope of the invention disclosed.

What the invention claimed is:

1. A retractable handle comprising:

a handgrip, said handgrip comprising a main control set;

two first tubes respectively connected to two distal ends of said handgrip and arranged in parallel;

two second tubes respectively sleeved with said first tubes for enabling said first tubes to be moved with said handgrip inward and outward of said second tubes between an extended position and a received position;

two first locating devices, for locking said first tubes in the extended position or the received position;

two third tubes respectively sleeved with said second tubes for enabling said second tubes to be moved inward and outward of said third tubes between an extended position and a received position, said third tubes each having a first retaining hole near a top end thereof and a second retaining hole near a bottom end thereof; and two second locating devices respectively provided in the bottom end of said second tubes and adapted to lock said second tubes in the extended position or the received position;

wherein said second locating devices each comprise:

a casing, comprising a top hole and a passageway, said passageway having a first end hole and a second end hole at two distal ends thereof;

a slide provided in said casing and enable which to move longitudinally, said slide comprising at least one first sloping face and at least one second sloping face positioned in said passageway of said casing;

a main elastic member provided in said casing and against between said slide and said casing;

a first retaining member and a second retaining member respectively positioned in the passageway of said casing and adapted to move in and out of the first end hole and second end hole of the passageway of said casing respectively, said first retaining member having at least one sloping face against the first sloping face of said slide, said second retaining member having at least one sloping face against the second sloping face of said slide;

a second elastic member positioned in the passageway of said casing and against between said first retaining member and said second retaining member;

when said second tubes are moved to the extended position, the first retaining members of said second locating devices are respectively engaged into the first retaining holes of said third tubes to lock said second tubes in the extended position; when said first tubes are respectively received and locked in said second tubes, the slides of said second locating devices are lowered with said first locating devices to force the first and second sloping faces thereof against the first and second retaining members of said second locating devices, thereby causing the first retaining members of said second locating devices to be disengaged from the first retaining holes of said third tubes and enabling said second tubes to be respectively received in said third tubes, and the second retaining members of said second locating devices are respectively forced outwards and engaged into the second retaining holes of said third tubes to lock said second tubes in the received position.

2. The retractable handle of claim 1 further comprising two fourth tubes respectively sleeved with said third tubes for enabling said third tubes to be moved inward and outward of said fourth tubes between an extended position and a received position, said fourth tubes each having a first retaining hole near a top end thereof and a second retaining hole near a bottom end thereof, and two third locating devices respectively provided in the bottom end of said third tubes and adapted to lock said third tubes in the extended position or the received position.

3. The retractable handle of claim 2 further comprising two fifth tubes respectively sleeved with said fourth tubes for enabling said fourth tubes to be moved inward and out ward of said fifth tubes between an extended position and a received position, said fifth tubes each having a first retaining hole near a top end thereof and a second retaining hole near a bottom end thereof, and two fourth locating devices respectively provided in the bottom end of said fourth tubes and adapted to lock said fourth tubes in the extended position or the received position.

4. The retractable handle of claim 1 wherein the casing of each of said second locating devices is comprised of an inner shell and an outer shell abutted against said inner shell.

5. The retractable handle of claim 4 wherein the casing of each of said second locating devices further comprises a lateral shell abutted against the respective inner shell and the respective outer shell.

6. The retractable handle of claim 1 wherein the casing of each of said second locating devices comprises a post provided at the inner surface thereof, a through hole axially extended through said post, and a pin inserted through said through hole to secure the casing to one second tube.

7. The retractable handle of claim 1 wherein the casing of each of said second locating devices comprises a transverse partition wall, which supports the corresponding main elastic member against the slide of the respective second locating device.

8. The retractable handle of claim 1 wherein the slide of each of said second locating devices comprises two drive plates arranged in parallel at a bottom side thereof and suspended in the passageway in the corresponding casing, said drive plates each comprising said at least one first sloping face and said at least one second sloping face disposed at two sides of the inner surfaces thereof.

9. The retractable handle of claim 1 wherein said third tubes each have a top end mounted with a connector.

* * * * *